United States Patent [19]

Brodeur et al.

[11] Patent Number: 4,589,558

[45] Date of Patent: May 20, 1986

[54] RAILROAD CAR WITH UNIVERSAL COUPLING CAPABILITY

[75] Inventors: Rene H. Brodeur, Wilmette; Boris S. Terlecky, Woodridge, both of Ill.

[73] Assignee: Trailer Train Company, Chicago, Ill.

[21] Appl. No.: 597,642

[22] Filed: Apr. 6, 1984

[51] Int. Cl.[4] ..... B61G 9/20

[52] U.S. Cl. ..... 213/50; 213/62 R;52;64; 105/3

[58] Field of Search ..... 213/50, 62 R, 64, 51, 213/52, 420; 105/3

[56] References Cited

U.S. PATENT DOCUMENTS

| | | | |
|---|---|---|---|
| 1,603,607 | 10/1926 | Kadel | 213/50 |
| 1,649,351 | 11/1927 | Kadel | 213/62 R |
| 1,799,090 | 3/1931 | Couch | 213/50 |
| 1,874,058 | 8/1932 | O'Connor | 213/50 |
| 1,981,918 | 11/1934 | Kinne | 213/50 |
| 2,055,473 | 9/1936 | Barrows | 213/64 |
| 2,261,383 | 11/1941 | Johnson | 213/50 |
| 2,307,862 | 1/1943 | Simonson | 213/50 |
| 3,220,563 | 11/1965 | Baker | 213/62 R |
| 4,422,557 | 12/1983 | Altherr | 213/62 R |

*Primary Examiner*—Ronald B. Cox

*Attorney, Agent, or Firm*—Haight, Hofeldt, Davis & Jambor

[57] ABSTRACT

A railroad car having universal coupling capability through provision of a coupling arrangement which permits connection to a standard coupler or a drawbar. The coupling arrangement includes facing sill side frames which define key slots and spaced stops to accommodate force transfer of traction and buff loads from either a coupler or a drawbar.

5 Claims, 6 Drawing Figures

RAILROAD CAR WITH UNIVERSAL COUPLING CAPABILITY

BACKGROUND OF THE INVENTION

This invention relates to railroad cars. More particularly, it relates to railroad cars with coupling arrangements convertible between conventional coupler and semi-permanent drawbar connections.

Recent concerns for economy in freight transportation have spurred development of a variety of new concepts in railroad rolling stock. These developments include new types of intermodal or trailer-on-flat car arrangements, as well as dual mode vehicles suitable for highway and rail travel.

Lightweight skeletal flatcars have been developed which are sized to carry one semi-trailer. To further minimize weight per axle and maximize productive tonage, such cars have been connected to form multi-platform cars with shared wheel trucks or bogies. Two or more, and as high as ten platforms have been linked through semi-permanent couplings to form a unit. Conventional trucks are disposed at the free ends of the first and last car. Intermediate car ends share a common truck. Examples are the "ten pack" cars operated by the Santa Fe Railroad. U.S. Pat. No. 4,233,909 shows such an arrangement.

A disadvantage of a multi-platform car of the type described is that the cars are not divisible into smaller units. Usage is therefore restricted to applications which insure full loading, such as special purpose unit trains having a specific route and schedule. Another disadvantage arises when repairs are required to one or more of the connected platforms. The entire coupled unit must be removed from service until repairs are completed.

An alternate form of economical intermodel car utilizes single axle trucks at each end of a platform to provide independent status and yet minimize per axle empty weight. These platforms may be coupled together in a conventional way, or in multiples of platforms with semi-permanent couplings to form a multi-platform unit. Examples of such platforms are found in U.S. Pat. No. 4,339,996.

Though most versatile, conventionally coupled cars present a certain weight disadvantage. Semi-permanent connections of cars with single axle trucks, of course, present disadvantages common to other forms of multi-platform car units.

The present invention is directed to providing a car with single axle trucks that possess flexibility to be utilized either as a conventional single platform car, or as a component of a multi-platform car having semi-permanent couplings between platforms.

SUMMARY OF THE INVENTION

The present invention encompasses a railroad car having a coupler pocket arranged to accept either a conventional car coupler, or alternatively, a semi-permanent drawbar connection. When forming the end unit of a multi-platform car, the car will include one conventional coupler and the opposite end will include a semi-permanent drawbar connection. When forming an intermediate platform between at least two other platforms, it will include a drawbar connection at each end. When used singly, the car will have a conventional coupler at each end.

The coupler pocket of the present invention is arranged to facilitate conversion between modes. Its particular advantages obtain regardless of th type of car body involved, or the type of rail support. The advantages of the unique coupler arrangement are suitable to any form of car.

DETAILED DESCRIPTION

Figure 1:
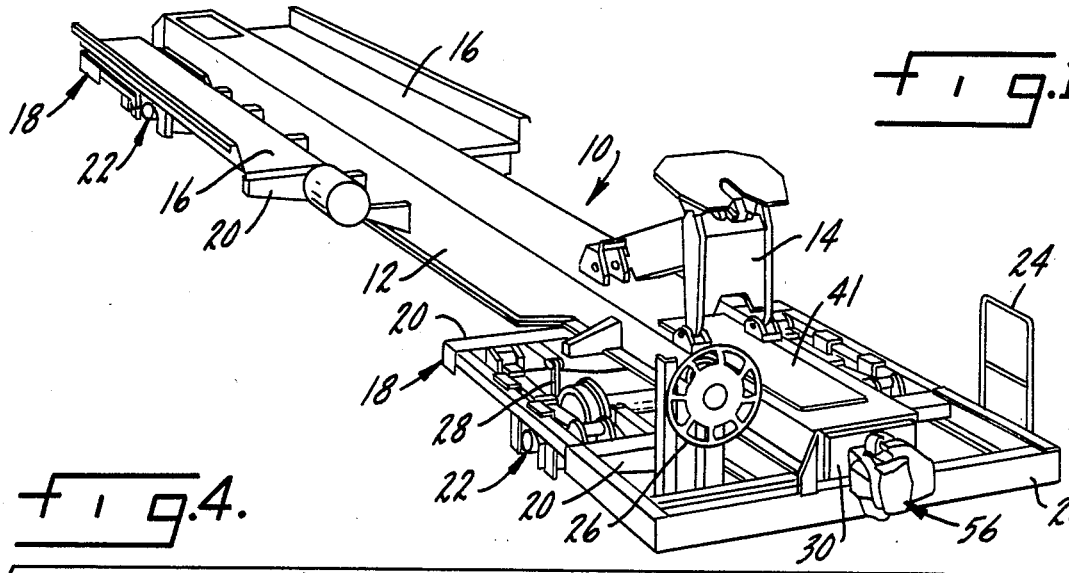
FIG. 1 is a perspective view of a railroad car with single axle trucks incorporating the features of the present invention.

Turning now to the drawings, there is illustrated a railroad flatcar embodying the principles of the present invention. The car could, of course, be a container car, auto carrier, or other format without departing from the scope of the invention. Though particularly intended for lightweight cars having single axle trucks, the coupler arrangement per se is applicable to any type car.

The car, generally designated by the numeral 10, is of a skeletical design to minimize weight, and is sized to transport a single semi-trailer. It includes a central core structure or centersill 12. The centersill is a hollow, channel beam comprised of welded plates and comprises the main structural member of the car. At one end, referred to as the "A" end, there is provided a hitch 14 which connects with, and secures the fifth wheel connection of a semi-trailer positioned upon the car. An opposite end, referred to as the "B" end, includes laterally directed wheel platforms 16 extending outwardly from centersill 12. These platforms, which continue along about one-third the overall length of the car, support the wheeled end of a semi-trailer.

Each end of the centersill 12 is provided with a rectangular framework 18, which includes transverse beams 20 rigidly secured to the centersill 12. These frameworks cooperate with, and connect the car 10 to single axle trucks 22 adjacent each end of the car. They further accommodate essential components such as grab iron 24, hand brakes 26 and brake rigging 28.

Each end of the car body 10 includes a coupler pocket generally designated 30 (best seen in FIGS. 2–5) formed integrally of the centersill 12. The pockets 30 embody the principles of the present invention and permit of the versatile arrangements contemplated for alternate single platform standard coupler cars and multi-platform cars connected by semi-permanent drawbar connections.

Figure 4:
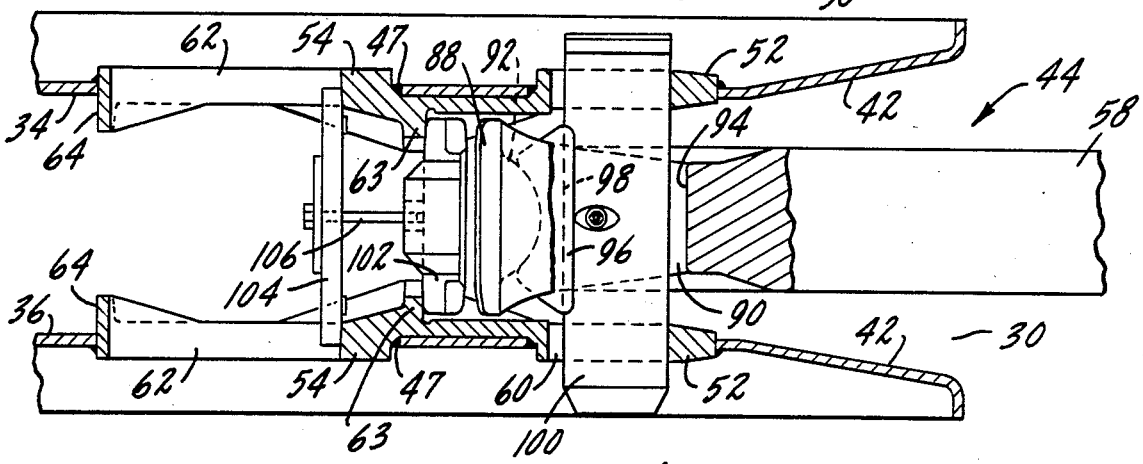
FIG. 4 is a top view of a railroad car with single axle trucks and incorporating the features of the present invention, and illustrating a semi-permanent drawbar in place.
Figure 5:
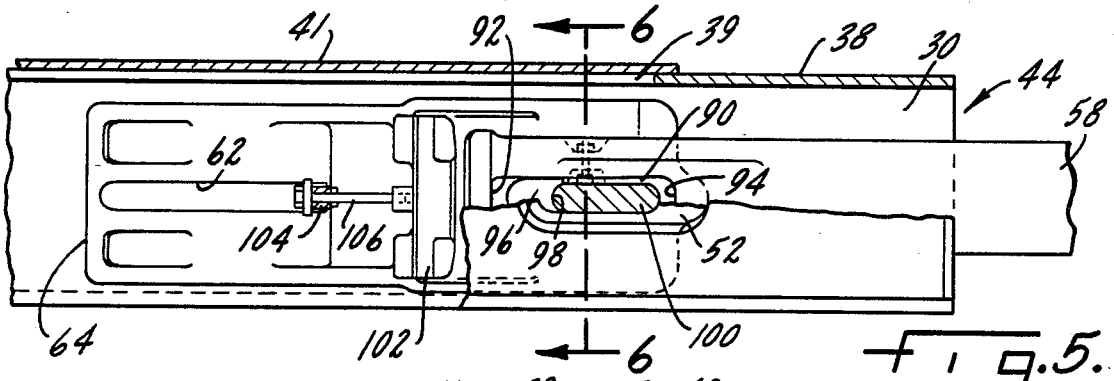
FIG. 5 is a side view, partially in section of the arrangement of FIG. 4.
Figure 2:
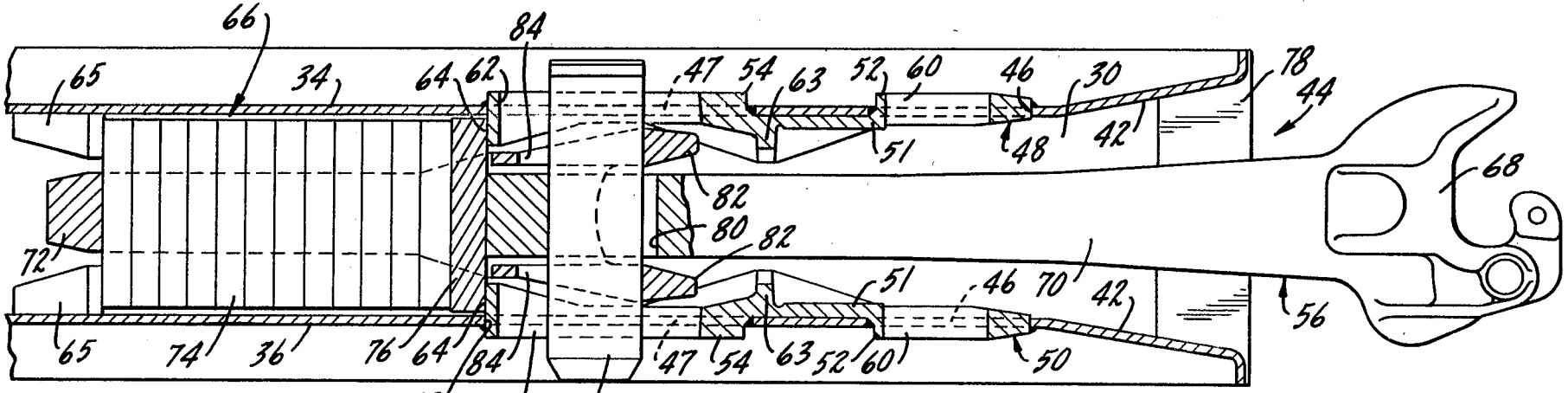
FIG. 2 is a top view, partially in section, showing a car incorporating the features of the present invention and illustrating a conventional end-of-car coupler in place.
Figure 3:
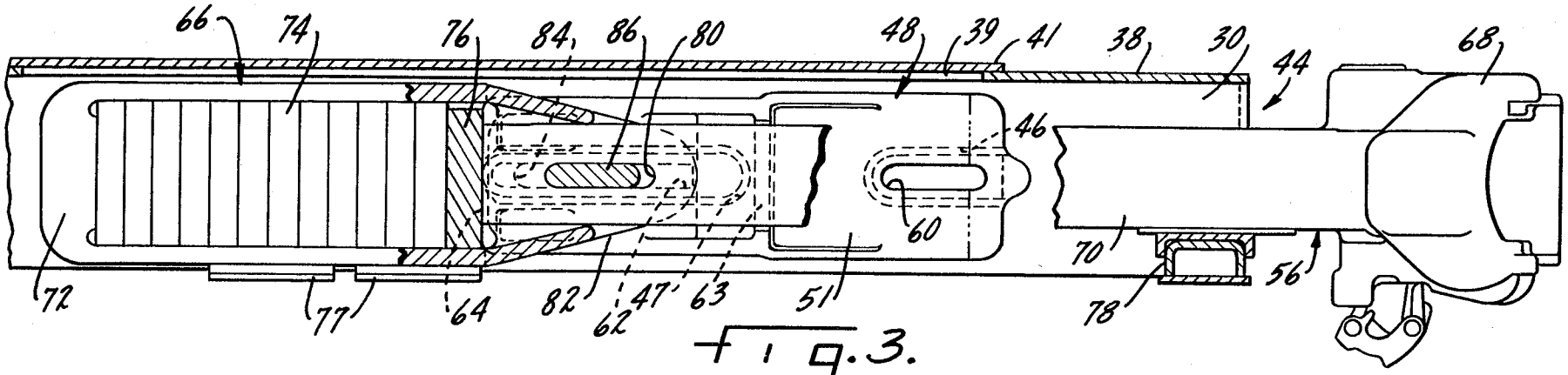
FIG. 3 is a side view, partially in section, of the arrangement of FIG. 2.

As best seen in FIGS. 2–5, the centersill 12 includes a pair of spaced apart vertical plates 34 and 36 welded to top plate 38, to form the channel beam construction of the main structural member of the car body. As illustrated in FIGS. 3 and 5, top plate 38 includes cut-outs or access openings 39 to provide egress into coupler pockets 30. Removable cover plate 41, shown in FIGS. 1 and 3, is provided to normally close each opening 39.

Vertical plates 34 and 36 include portions 42 adjacent the end of the sill which are disposed at an acute angle to the longitudinal centerline of the car 10. These portions form a wide mouth opening 44 which accommodates lateral pivoting of the car coupling member as the car negotiates curves.

FIGS. 2–5 show in enlarged detail one end of carbody 10 and particularly illustrate the embodied inventive concept. These views are considered typical of the coupler pocket 30 at either end of car 10, though in certain instances it is necessary to include only one such coupler pocket. This is true of end units of a multi-platform car which require only a conventional non-convertible coupler at the free end.

As best seen in FIGS. 2–5, each vertical plate 34 and 36 includes elongate, longitudinally spaced, openings or cut-outs 46 and 47 about midline of vertical plates 34 and 36 and positioned just inwardly of the vertical portions 42. In accordance with the present invention, sill side frame, or casting 48 and sill side frame, or casting 50 are disposed in overlying relation respectively to the openings 46 and 47 of vertical plates 34 and 36.

Frames 48 and 50 are mirror images and are disposed in oppositely facing cooperating relation. Each includes body 51 elongated in the longitudinal direction of the centersill 12. Transverse webs 52 and 54 extend from the body of each frame or casting 48 and 50 outwardly or in a direction away from the opposing frame and through openings 46 and 47 of plates 34 and 36. The castings are welded in place about these webs. So disposed, they form an integral portion of the sidewalls 34 and 36 of the coupler pocket 30 and comprise means for force transfer to car body 10.

Figure 6:
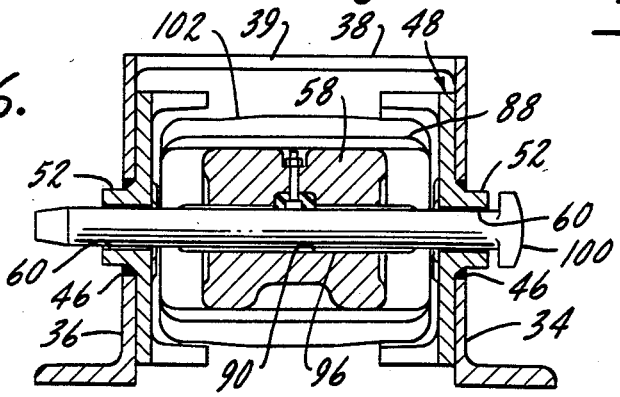
FIG. 6 is a sectional view of the apparatus of FIG. 5 taken along the lines 5—5 of the Figure.

FIGS. 2 and 3 illustrate a standard "E" type coupler, designated 56, in place in the coupler pocket 30. FIGS. 4, 5 and 6 illustrate the same pocket 30, with an aligning drawbar 58 in place to form a semi-permanent connection between adjacent ends of car 10. The feature significant to the invention is that either type connection may be accommodated by coupler pockets 30 of car 10. Also, the pockets are arranged such that the connection may be readily converted from a coupler to a drawbar at either or both ends of the car, depending upon the arrangement desired for the particular intended service.

As best seen in FIG. 2, each of the castings 48 and 50 includes a forward draft key slot 60 formed in web 52 nearest wide mouth opening 44 and a rearward draft key slot 62 formed in web 54 which are aligned with the corresponding slots in the opposing casting. Intermediate the key slots 60 and 62, castings 48 and 50 include intermediate webs or stops 63 which extend from the body 51 inwardly, or in a direction opposite to webs 52 and 54. The ends of each casting furtherest from wide mouth opening 44 of the pocket 30 further define rear flanges or stops 64 similarly directed inwardly of body 51 in a direction opposite webs 52 and 54. Beyond stops 64, within centersill 10, there is provided a pair of draft gear stop blocks 65. Intermediate these blocks and the stops 64 the centersill plates define a chamber 66 to receive a draft gear or cushioning device as will become apparent.

The coupler arrangement 56 includes a coupler head 68 with integrally formed shank 70, coupler yoke 72, standard cushioning device 74 disposed within yoke 72 and follower block 76. The cushioning device 74 is supported in chamber 66 by cross members 77. Coupler carrier 78, a channel welded to the bottom edge of plates 34 and 36 adjacent wide mouth opening 44 supports the coupler adjacent head 68.

Shank 70 includes a key slot 80. Yoke 72 includes webs 82 which overlie shank 70 and define key slots 84. Slots 62 formed in sill side castings 48 and 50 are sized to permit passage of a standard key 86 which is disposed in key slots 80 and 84 of the coupler shank 70 and yoke webs 82. A standard key retainer (not shown) is used to removably retain the standard key in position.

In the arrangement illustrated in FIGS. 2 and 3 tractive effort to coupler 56 is transmitted to the car body centersill 12 through cushioning device 74. In traction, the rearward edge of key slot 80 engages key 86 and pulls it into contact with the forward edges of slots 84 in webs 82 of yoke 72. Yoke 72 compresses cushioning device 74 against draft gear follower block 76 to impart traction forces to the flanges or webs 64 of sill side castings 48 and 50.

In buff loading, the rearward end of shank 70 of coupler 56 engages the face of draft gear follower block 76 between webs or flanges 64. Block 76 urges cushioning device 74 toward the stop blocks 65 at the rearward end of chamber 66 and compresses it against those stops. The blocks 65 transmit the buff loading to centersill 12. Key slots 62 in sill side castings 48 and 50 are sufficiently elongated along the longitudinal extent of the centersill 12 to permit movement of the coupler components without interference with key 86.

Turning now to FIGS. 4–5, the universal coupling arrangement of the present invention is illustrated with a semi-permanent drawbar 58 in place. The drawbar 58 is symmetrical at each end and is similarly coupled adjacent ends of adjacent flatcars 10 to form a semi-permanent connection between two platforms. For simplicity, connection of the drawbar 58 to only one platform is described.

Drawbar 58 includes a generally rectangular butt end 88 at each end. Inwardly of each butt end 88 there is formed a key slot 90 generally aligned with forward key slots 60 of sill side castings 48 and 50.

Rearward surface 92 of key slot 90 is generally semi-cylindrical. Forward edge or surface 94 is generally transverse of the longitudinal length of the drawbar. A follower 96 is disposed within the slot 90 which includes a compatible rearwardly facing surface to engage surface 92 for lateral pivotal movement.

Follower 96 also includes a forward surface 98. Standard draft key 100 extends through frontal key slots 60 of sill side castings 48 and 50 and between forward facing surface 98 of follower 96 and forward edge 94 of slot 90 in drawbar 58. A standard draft key retainer (not shown) may be utilized to removably retain key 100 in position.

In the embodiment illustrated in FIGS. 4 and 5 which depicts a drawbar connection between adjacent cars 10, a buff bearing block 102 is removably installed rearwardly of each butt end of drawbar 58. The buff bearing block 102 is secured to sill side castings 48 and 50 in abutting contact with inwardly directed stops 63. A removable cross bar 104 engaging the forward edge of rearward draft key slots 62 is connected to the bearing block by bolts 106 to retain the bearing block in place.

Traction forces are transmitted by drawbar 58 to car 10 through standard draft key 100. In traction, forward facing surface 98 of follower 96 engages draft key 100 and urges it against the forward edge of frontal draft key slots 60 in sill side castings 48 and 50. The sill side castings transmit the load to the vertical centersill plates 34 and 36.

As best seen in FIG. 5, the draft key slot 90 widens or diverges slightly in the direction forward from semi-cylindrical surface 92 toward forward edge 94. This permits the drawbar 58 to pivot vertically with respect to standard draft key 100 and avoids excessive wear. Lateral pivoting is accommodated by the movement of follower 96 upon surface 92 and the spacing of forward edge 94 sufficiently forward of forward facing surface 98 to permit lateral pivoting of the drawbar relative to the key 100.

Buff loading is transmitted to the car 10 by drawbar 58 through engagement of butt end 88 with buff bearing block 102. This contact transmits the buff forces to flanges or stops 63 of sill side castings 48 and 50 and to centersill 12.

As illustrated in FIG. 5, there is a degree of clearance between butt end 88 of drawbar 58 and buff bearing block 102 when the drawbar is in traction. This spacing permits the necessary vertical and lateral motion of the drawbar 58 without binding upon key 100. It should also be noted that in buff, when the butt end 88 of drawbar 58 contacts buff bearing block 102, forward edge 94 of slot 90 is spaced sufficiently from follower 96 to prevent binding upon draft key 100. The widening shape of key slot 90 also permits freedom of vertical pivoting movement without binding upon the key.

Contact of each of the butt ends 88 of drawbar 58 with respective buff bearing blocks 102 of adjacent cars during buff loading produces lateral and vertical restoring forces to maintain lateral alignment.

As can be appreciated, the sill side castings 48 and 50 are arranged to provide utilization of either a conventional coupler 56 or a drawbar 58 with a minimum of effort. The advantages of such an arrangement are attainable regardless of the form of car body involved. Though illustrated as castings, these elements could be formed by fabrication, or othewise without departing from the scope of the disclosed inventive concepts.

It will be apparent to those skilled in the art that various additions, substitutions, modifications and omissions may be made to the construction of the present invention without departing from the scope or spirit of the invention. Thus, it is intended that the present invention cover the additions, substitutions, modifications and omissions of theis invention which come within the permissible scope of the appended claims.

We claim:

1. A coupling arrangement for a railroad car having a centersill with parallel sidewalls defining a coupler pocket adjacent at least one end of said car, said arrangement comprising opposing will side frames secured to each said sidewall in oppositely facing cooperating relation, each said sill side frame being generally longitudinally elongate in the direction of the longitudinal extent of said centersill and including a frontal draft key slot nearest the end of said car, a rearward draft key slot, inwardly directed stops intermediate said frontal draft key lot and rearward draft key slot and generally aligned with and facing the inwardly directed stop of the opposing sill side frame, and rear webs facing inwardly, disposed rearward of said rearward draft key slot and generally aligned with, and facing the rear webs of the opposing sill side frame.

2. A coupling arrangement for a railroad car as defined in claim 1 wherein said coupling arrangement is adapted to receive a conventional car coupler having a coupler head, integral shank defining a draft key slot, a yoke having webs defining draft key slots aligned with the draft key slot of said shank, a standard draft key operatively connecting said slots of said shank and said webs of said yoke, a cushioning device disposed in said yoke, and a follower block in said yoke adjacent said cushioning device, said coupling arrangement adapted to receive said conventional car coupler intermediate said parallel side walls of said centersill with said yoke, and cushioning device and said follower block disposed rearward of said rear stops of sill side frames with said follower block engaging said rear stops to prevent movement of said block, and said cushioning device, toward the end of said car, and said standard draft key of said conventional coupler extending through said rearward draft key slots of said sill side frames, said rearward slots being sized to permit longitudinal movement of said draft key toward and away from said end of said car without engaging said sill side frames.

3. A coupling arrangement for a railroad car as claimed in claim 2 wherein said coupling arrangement is adapted to receive a drawbar to form a semi-permanent connection to an adjacent car, wherein said drawbar includes a butt end, and a draft key slot formed therein adjacent the butt end and generally aligned with the frontal draft key slot of said sill side frames, said coupling arrangement further includes a buff bearing block disposed intermediate said frontal and rearward draft key slots engaging said intermediate inwardly directed stops of said sill side frames to prevent movement of said bearing block away from the end of said car, the butt end of said drawbar being adapted to contact said buff bearing block during buff loading, and a draft key disposed in said frontal draft key slots of said sill side frames and extending through said slot of said drawbar, said key transmitting traction loads to said car from said drawbar through engagement with said sill side frames.

4. A coupling arrangement for a railroad car as claimed in claim 3 wherein said arrangement further includes a cross bar disposed in said rearward draft key slots of said sill side frames and is connected to said buff bearing block to removably secure said bearing block in position against said intermediate inwardly directed stops.

5. A coupling arrangement for a railroad car as claimed in claim 1 wherein said sill side frames each includes a web defining said frontal draft key slot and a web defining said rearward draft key slot, said parallel side walls of said centersill include apertures therein to receive said webs, said webs of one of said frames being disposed in said apertures of one of said parallel side walls and the webs of the other of said frames being disposed in the apertures of the other of said parallel side walls.

* * * * *